US007536845B1

(12) United States Patent
Cote et al.

(10) Patent No.: US 7,536,845 B1
(45) Date of Patent: May 26, 2009

(54) STEP EXTENSION FOR STIRRUP

(76) Inventors: Deborah Cote, 1308 Addiewell Pl., San Jose, CA (US) 95120; John Peter Haruff, 911 Ebbets Dr., Campbell, CA (US) 95008

( * ) Notice: Subject to any disclaimer, the term of this patent is extended or adjusted under 35 U.S.C. 154(b) by 0 days.

(21) Appl. No.: 11/267,733

(22) Filed: Nov. 4, 2005

(51) Int. Cl.
*B68C 3/00* (2006.01)

(52) U.S. Cl. ..... 54/49

(58) Field of Classification Search ..... 54/47, 54/48, 49, 49.5; 174/66; 220/241
See application file for complete search history.

(56) References Cited

U.S. PATENT DOCUMENTS

| | | | | |
|---|---|---|---|---|
| 54,380 | A | 5/1866 | Martin | |
| 194,609 | A | 8/1877 | Burton | |
| 211,732 | A * | 1/1879 | Hensley | 54/49 |
| 267,728 | A | 11/1882 | Shellenberger | |
| 469,947 | A | 3/1892 | Phelps | |
| 634,858 | A | 10/1899 | Turner | |
| 663,523 | A | 12/1900 | Turner | |
| 1,062,327 | A * | 5/1913 | Erbe | 54/49 |
| 2,187,983 | A | 1/1940 | Moore | |
| 5,738,540 | A * | 4/1998 | Hetherington | 439/536 |
| 6,629,945 | B1 | 10/2003 | Stromgren | |
| 2005/0205284 | A1 * | 9/2005 | Ray | 174/66 |

* cited by examiner

*Primary Examiner*—Rob Swiatek
(74) *Attorney, Agent, or Firm*—Jack Lo

(57) ABSTRACT

A step extension for a stirrup is comprised of a top plate for attaching on top of a step member of the stirrup, and a bottom plate for attaching to the bottom of the step member. Fasteners connected between the top and bottom plates secure them to the step member. The top plate has a rear extension for providing better foot support and improving stirrup control. The rear extension extends between an outer portion of the step member and the mid portion of the step member. The top plate has an inner portion which is devoid of any extension, so that its rear edge terminates generally flush with the rear edge of the step member. The lack of a rearward extension on the inner portion of the top plate avoids locking the rider's foot in the stirrup when the rider falls off.

2 Claims, 2 Drawing Sheets

STEP EXTENSION FOR STIRRUP

BACKGROUND OF THE INVENTION

1. Field of the Invention

The invention broadly relates to horses stirrups.

2. Prior Art

A typical riding stirrup 10 shown in FIG. 1 is comprised of a step member 11 for supporting a foot, and a hanger 12 attached to step member 11 for hanging from a saddle. Step member 11 is comprised of an oval shaped loop 13 with a center aperture 14. Hanger 12 has an inverted U shape with a pair of arms 15, wherein lower ends 16 of arms 15 are attached to opposite sides of step member 11. A slit 17 is provided at the top of hanger 12 for attaching to a stirrup supporting strap on a saddle.

The relatively narrow step member 11 does not provide enough support for proper stirrup control and rider stability. Therefore, some stirrups provide a longer step member for better support, as shown in U.S. Pat. No. 267,728 to Shellenberger. However, the longer step member may lock the foot in the stirrup when the rider falls off and cause the rider to be injured. Some stirrups provide a pair of rear extensions in the step member for better support, as shown in U.S. Pat. No. 663,523 to Turner. However, the extensions function the same way as a single wider extension, so they may still lock the foot in the stirrup when the rider falls off.

BRIEF SUMMARY OF THE INVENTION

A step extension for a stirrup is comprised of a top plate for attaching on top of a step member of the stirrup, and a bottom plate for attaching to the bottom of the step member. Fasteners connected between the top and bottom plates secure them to the step member. The top plate has a rear extension for providing better foot support and improving stirrup control. The rear extension extends between an outer portion of the step member and the mid portion of the step member. The top plate has an inner portion which is devoid of any extension, so that its rear edge terminates generally flush with the rear edge of the step member. The lack of a rearward extension on the inner portion of the top plate avoids locking the rider's foot in the stirrup when the rider falls off.

DRAWING REFERENCE NUMERALS

10. Stirrup
11. Step Member
12. Hanger

-continued

13. Loop
14. Aperture
15. Arms
16. Lower Ends
17. Slit
18. Top
19. Bottom
20. Step Extension
21. Top Plate
22. Bottom Plate
23. Fastener
24. Notch
25. Rear Extension
26. Outer Portion
27. Mid Portion
28. Inner Portion
29. Rear Edge

DETAILED DESCRIPTION OF THE INVENTION

FIGS. 2-3

Figure 1:
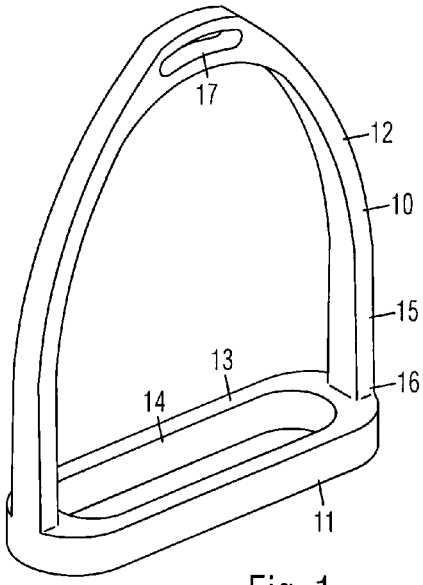
Fig. 1 Prior Art
FIG. 1 is a rear perspective view of a prior art riding stirrup.
Figure 2:
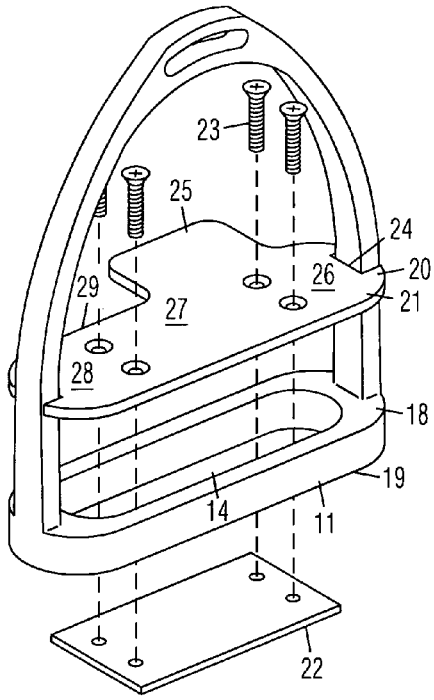
FIG. 2 is an exploded view of the present step extension being assembled with the stirrup.

A preferred embodiment of a step extension 20 for stirrup 10 is shown an exploded view in FIG. 2. Step extension 20 is comprised of a top plate 21 for attaching on a top 18 of step member 11 of stirrup 10, and a bottom plate 22 for attaching to a bottom 19 of step member 11. Fasteners 23 are arranged for positioning through top plate 21, aperture 14, and bottom plate 22 to secure top and bottom plates 21 and 22 to step member 11.

Figure 3:
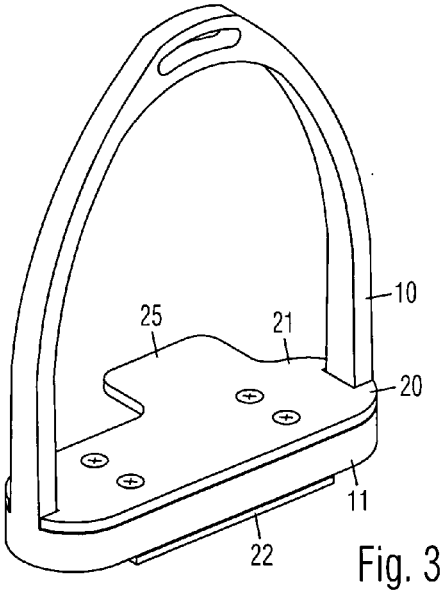
FIG. 3 is a rear perspective view of the step extension assembled with the stirrup.

Top plate 21 includes notches 24 on opposite sides for embracing lower ends 16 of hanger 12. Top plate 21 include a rear extension 25 for providing better foot support and improving stirrup control. Alternatively, rear extension 25 may be integrally provided with step member 11 instead of being an add-on. Rear extension 25 is generally positioned between an outer portion 26 of top plate 21 and a mid portion 27 of top plate 21. Top plate 21 has an inner portion 28 devoid of any rear extension, so that a rear edge 29 thereof terminates generally flush with the rear of step member 11. The lack of a rear extension on inner portion 28 of top plate 21 avoids locking the rider's foot in stirrup 10 when the rider falls off. Step extension 20 is shown assembled with stirrup 10 in FIG. 3.

FIGS. 4-6

Figure 4:
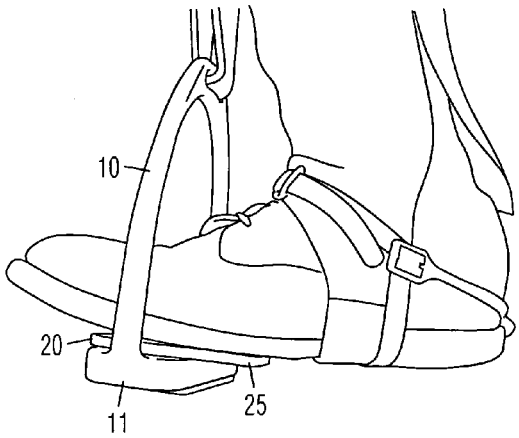
FIG. 4 is a side perspective view of the step extension and the stirrup in use.
Figure 5:
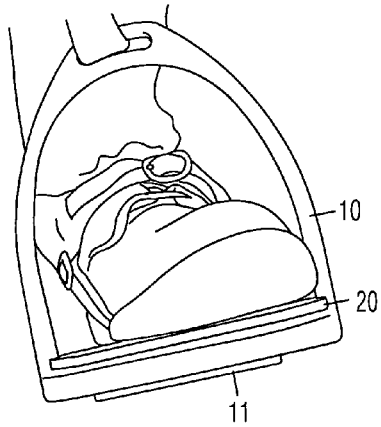
FIG. 5 is a front view of the step extension and the stirrup in use.
Figure 6:
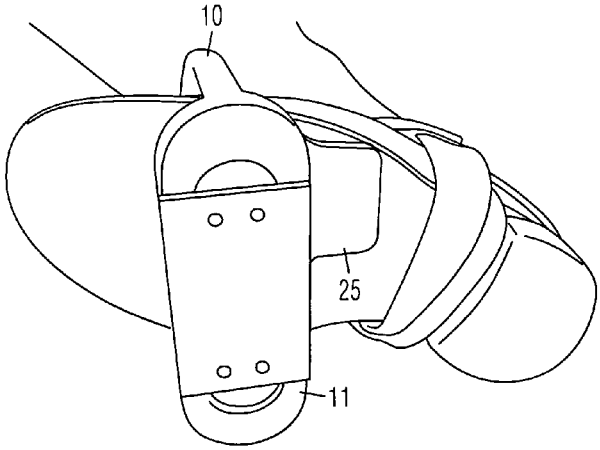
FIG. 6 is a bottom perspective view of the step extension and the stirrup in use.

Step extension 20 is shown in use on stirrup 10 in FIGS. 4-6. Rear extension 25 provides additional area to step on for improved stirrup control and rider stability. The inner portion of step 11 is devoid of any extension to avoid locking the rider's foot in the stirrup when the rider falls off.

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. Therefore, the scope of the invention should be determined by the appended claims and their legal equivalents, not by the examples given.

We claim:

1. A step extension for a stirrup, comprising:

a top plate for attaching on a top of a step member of said stirrup, wherein said top plate includes a rear extension for providing improved foot support, said rear extension is generally positioned between an outer portion of said top plate and a mid portion of said top plate, an inner portion of said top plate is substantially devoid of extension to avoid locking a rider's foot in said stirrup when said rider falls off;

wherein a rear edge of said inner portion of said top plate is arranged to be generally flush with a rear edge of said step member.

2. A stirrup, comprising:

a hanger;

a step member attached to a lower end of said hanger; and a rear extension on said step member providing improved foot support, wherein said rear extension is generally positioned between an outer portion of said step member and a mid portion of said step member, an inner portion of said step member is substantially devoid of extension to avoid locking a rider's foot in said stirrup when said rider falls off.

* * * * *